US005272407A

United States Patent [19]

Tillman et al.

[11] Patent Number: 5,272,407

[45] Date of Patent: Dec. 21, 1993

[54] ELECTRIC LAMP HAVING SCREENS FOR REDUCING PHOTO ELECTRON EMISSION

[75] Inventors: Nancy Tillman, Mechelen, Belgium; Daniel H. Brownell, Hornell, N.Y.; Dale E. Work, Flemington, N.J.

[73] Assignee: North American Philips Corporation, New York, N.Y.

[21] Appl. No.: 810,744

[22] Filed: Dec. 18, 1991

[51] Int. Cl.[5] ..... H01J 61/02; H01J 61/04

[52] U.S. Cl. ..... 313/25; 313/622; 313/239

[58] Field of Search ..... 313/25, 623, 626, 238, 313/239, 284, 285

[56] References Cited

U.S. PATENT DOCUMENTS

| | | | |
|---|---|---|---|
| 3,424,935 | 1/1969 | Gungle et al. . | |
| 3,484,637 | 12/1969 | Van Boort et al. . | |
| 3,662,203 | 5/1972 | Kuhl et al. . | |
| 3,780,331 | 10/1973 | Knochel et al. . | |
| 4,171,498 | 10/1979 | Fromm . | |
| 4,479,071 | 10/1984 | T'Jampens et al. . | |
| 4,625,141 | 11/1986 | Keeffe et al. | 313/25 |
| 4,866,328 | 9/1989 | Ramaiah et al. | 313/25 |
| 4,961,019 | 10/1990 | White et al. | 313/25 |

*Primary Examiner*—Donald J. Yusko

*Assistant Examiner*—N. D. Patel

*Attorney, Agent, or Firm*—Brian J. Wieghaus

[57] ABSTRACT

A single-ended electric lamp having an alkali-halide containing light source which produces ultraviolet radiation and is supported within an outer envelope by metallic support structure having an elongate support rod extending past the arc tube. A tubular cover extends over a length L1 of the support rod and the remainder of the support structure remains uncovered. A screen is interposed between the light source and an uncovered portion of the metal support structure to prevent ultraviolet radiation emitted from said light source from directly impinging on said uncovered portion. Preferably, a plurality of screens are arranged within the outer envelope to block the line of sight from the light source to any uncovered portion of the metal support structure and to reduce the quantity of reflected ultraviolet radiation reflected off the inner surface of the arc tube which impinges on uncovered portions of the metal support structure. The tubular cover and the interposed screens are comprised of a material substantially opaque to ultraviolet radiation and having a high photoelectric work function. The interposed screen(s) further reduce the production of photoelectrons and substantially reduce the voltage rise of the arc tube over the life of the lamp.

20 Claims, 2 Drawing Sheets

ELECTRIC LAMP HAVING SCREENS FOR REDUCING PHOTO ELECTRON EMISSION

BACKGROUND OF THE INVENTION

1. Field of the Invention

The invention relates to single-ended electric lamps having an alkali-halide containing light source which produces ultraviolet radiation and is supported within an outer envelope by metallic support structure. More particularly, the invention relates to improvements for reducing photoelectron emission from the metallic support structure caused by ultraviolet radiation from the light source.

2. Description of the Prior Art

Photoelectron emission can be very detrimental in electric discharge lamps having an arcttube which contains an ionized plasma of alkali-halides during lamp operation, such as metal halide discharge lamps. The discharge vessel, or arc tube, of metal halide lamps is typically fused quartz glass and contains a filling comprised of mercury, sodium halide and other metal halides which are effective to contribute to the spectrum of light developed during lamp operation. A well-known characteristic of metal halide discharge lamps is the increase in lamp voltage that occurs over the lifetime of such lamps. Sodium ions diffuse through heated fused quartz glass, so that the sodium content within the lamp discharge vessel is progressively depleted during the course of lamp operation. The progressive loss of sodium results in a progressive increase in lamp operating voltage and also causes an unacceptably large increase in correlated color temperature (CCT) over the life of the lamp. The increase in correlated color temperature is particularly problematic in low wattage metal halide lamps, e.g. lamps having a rated wattage of 100W or less. At some time during the life of the lamp, its operating voltage may rise to a level greater than that provided by the lamp ballast, thus causing the lamp to extinguish. Sodium loss, and not deterioration of the lamp components, is frequently the determinant of lamp life.

Sodium diffusion through the arc tube is accelerated by any negative space charge within the outer envelope of the lamp. The negative space charge occurs if ultraviolet radiation from the discharge strikes metal components within the lamp and causes the production of photoelectrons.

Single-ended discharge lamps, i.e. lamps having an outer envelope with a lamp cap at only one end, employ metal frames for supporting the arc tube, typically axially, within the outer envelope and electrically connecting the lead-throughs at each end of the arc tube to respective terminals on the lamp cap. A principal frame component is an elongate metal support rod, or wire, extending within the lamp outer envelope past the arc tube and connected to the lead-through remote from the lamp stem. This support rod, along with other metallic frame structure, is exposed to ultraviolet radiation from the arc tube and emits a substantial flux of photoelectrons, especially in low wattage metal halide lamps where the support rod and other support structure is close to the arc tube because of the compact outer bulb employed. Accumulation of the photoelectrons causes the negative space charge and the attendant acceleration of sodium loss.

An established technique for reducing photoelectron production, and thereby reducing the rate of sodium loss, is to physically cover, wherever practical, metal components within the lamp outer envelope with material impervious to ultraviolet radiation and having a high photoelectric work function. U.S. Pat. No. 3,484,637 (van Boort et al) discloses a mercury vapor discharge lamp in which the metal support rod is covered by a refractory dielectric tube comprised of a ceramic of alumina and silica. The ceramic tube shields the covered portion of the metal rod from ultraviolet radiation, thereby reducing photoelectron production. A similar approach is disclosed in U.S. Pat. No. 3,780,331 (Knochel et al) in which a ceramic or fused quartz glass tube physically covers the support rod. Knochel further teaches the addition of a photoelectron collector and the use of a stainless steel rod having a chrome oxide surface, in place of the nickel plated iron support normally used. U.S. Pat. No. 4,171,498 (Fromm et al) likewise teaches the use of a fused quartz tube covering the support rod for reducing photoelectron emission. A fused quartz tube does not block the ultraviolet radiation from the conductor but is effective for trapping photoelectrons within the tube and substantially preventing photoelectrons from collecting on the arc tube.

In the above lamps having a covered support rod, the major part of the rod is straight and the ceramic or quartz glass tube covering the rod is straight. Major portions of the support structure remain uncovered and exposed to ultraviolet radiation because of sharp bends which cannot be covered with a single ceramic or glass tube, and/or short lengths which are impractical for cost/assembly reasons to provide with a tubular cover. These exposed portions include the bent end portion of the metal rod which extends from the stem press, the opposite end portion which is often connected to a dimple at the dome-end of the bulb, the metal conductor extending from the arc-tube lead-through to the metal support rod near the end remote from the lamp base, and the two lead-throughs extending from the arc tube.

Another alternative, disclosed in U.S. Pat. No. 4,866,328 (Ramaiah et al), is to cover parts of the metal support structure with a layer of zirconium oxide having a high photoelectric work function to reduce photoelectron emission. The zirconium oxide is granular and is applied mixed with an organic binder for adhering the zirconium to the metal support structure. However, to achieve acceptable adherence, the metal support structure needs to be sandblasted prior to coating and the coating must be baked to dry the binder, thus increasing the cost of the lamp.

Another approach to reducing photoelectron emission is to reduce the amount of metal in close proximity and in direct view of the arc tube. U.S. Pat. No. 3,424,935 (Gungle et al) discloses a single-ended metal halide lamp which eliminates the elongate support rod adjacent the arc tube by providing metallic structure only at the opposing ends of the outer envelope for supporting respective ends of the arc tube. The pinch seals of the arc tube are connected to the metal structure by conventional metal straps. A fine tungsten field wire extending proximate the curved envelope wall provides a conductive path between the lamp base and the far end of the discharge tube. Despite the elimination of the conductive support rod in Gungle, a substantial amount of photoelectrons are produced because the support structure at the ends is still exposed to ultraviolet radiation from the arc tube.

U.S. Pat. Nos. 3,662,203 (Kuhl et al) and 4,479,071 (T'Jampens et al) disclose double-ended metal halide discharge lamps in which the arc tube is enclosed in a narrow tubular outer envelope having a lamp cap at each end. The outer envelope has an inner diameter smaller than about three times that of the outer diameter of the arc tube. In the Kuhl patent, metallic holders are fixed to the arc-tube lead-throughs and have a plurality of fingers contacting the outer envelope to support and center the arc tube therein. Flexible current conductors connected to the holders extend through the outer envelope for energizing the arc tube. T'Jampens replaces the metallic holders of the Kuhl lamp with holders comprising boron nitride, which are impervious to UV radiation, thus eliminating a major source of photoelectrons.

For single-ended lamps having an elongate support rod, the most common commercial design remains the use of a ceramic or fused quartz tube over the straight portion of the support rod, with the attendant disadvantages previously discussed. Good design practice in reducing the amount of metal within the outer envelope may help reduce photoelectron production, but any practical arc tube support will necessarily include several metal parts of substantial mass and dimensions that are large relative to the overall lamp dimensions.

Accordingly, it is an object of the invention, in an electric lamp having a light source which produces ultraviolet radiation and an elongate support rod extending past the light source, to provide a practical and cost-effective means for more completely shielding the metal structure within the lamp envelope to suppress the emission of photoelectrons.

SUMMARY OF THE INVENTION

According to the invention, an electric lamp is comprised of a single-ended outer envelope and an alkali-halide containing light source that emits ultraviolet radiation. The light source is mounted within the outer envelope and electrically connected to the lamp cap by metal support structure comprising an elongate conductive support rod extending past the arc tube. The support-rod and remaining elements of the support structure are in the line of sight of ultraviolet radiation from the light source. To suppress photoelectron production, a cover extends over a length of the support rod and a screen is arranged with the outer envelope spaced from an uncovered portion of said support structure not covered by said cover on said support rod. The screen blocks the line of sight to, but does not physically cover, said uncovered portion of the metal support structure to prevent ultraviolet radiation emitted directly from the light source from impinging directly on said uncovered portion. The uncovered, but screened, portion substantially does not produce any photoelectrons. The screen comprises material substantially opaque to ultraviolet radiation and having a high photoelectric work function. A high photoelectric work function as used in the specification and claims is a work function greater than about five electron volts (5 e.v.).

Preferably, a plurality of such screens are provided within the outer envelope, which screens are shaped and positioned to block the line of sight from the light source to any portion of the metal support structure not covered by said cover on the elongate support rod and to reduce the amount of reflected ultraviolet radiation impinging on the uncovered metal support structure which is reflected off the inner surface of the outer envelope.

The invention is based on the recognition that a screen positioned in the line of sight between the light source and any exposed metal support structure will prevent ultraviolet radiation from the arc tube from impinging on said exposed metal structure and emitting photo electrons. Thus, such screens can be used to reduce or eliminate photoelectron production from the curved and bent portions of the support structure which to date have remained uncovered in commercial metal halide lamps.

In a favorable embodiment of the invention, the lamp includes a pair of screens spaced at opposite ends of the light source. This provides for a convenient mounting of the screens on the lead-throughs which extend from the light source while providing a large cut-off, or shadow, angle of ultraviolet radiation of the arc tube.

In a further embodiment of the lamp, a major portion of the elongate support rod is straight and the cover of material thereon is a straight tube of said material with said elongate support rod extending therethrough. The tubular cover extends over a distance L1 on said major portion of said support rod, and said screens are positioned transversely within said envelope and spaced a distance L2, where $L2<L1$. The screens are circular-planar, i.e. disk-shaped, and have diameters extending to said straight tube of material.

Another embodiment is based on the recognition that photoelectron production is caused not only by ultraviolet radiation which impinges on said uncovered support structure directly from the light source but also that which is first reflected of the inner surface of the outer envelope. According to this embodiment, the screens extend transversely past said support rod, terminating proximate the inner surface of the outer envelope, and include an opening through which said support rod and cover extend. The larger screen diameter is favorable for minimizing the reflected radiation which impinges on the uncovered portions of the support structure. A disadvantage, however, of such large diameter screens when positioned at the opposite ends of the arc tube is that they also undesirably restrict the beam angle of light emitted from the light source if they are of a material opaque to visible light. Accordingly, it is favorable if the screens are dome-shaped and convex to the light-source. This shape allows for an acceptable beam spread from the light source while effectively blocking direct and reflected ultraviolet radiation from impinging on any uncovered support structure.

According to a preferred embodiment of the invention, the light source is a metal halide ar tube having opposing sealed ends, spaced discharge electrodes disposed within the arc tube, and conductive lead-throughs extending from the electrodes through a respective sealed end to the exterior of the arc tube. The arc tube has a fill of mercury, sodium halide and one or more other metal halides.

BRIEF DESCRIPTION OF THE DRAWINGS

FIG. 1*a* shows an isolated top view of the convex screen 20 of FIG. 1;

DETAILED DESCRIPTION OF THE INVENTION

Figure 1:
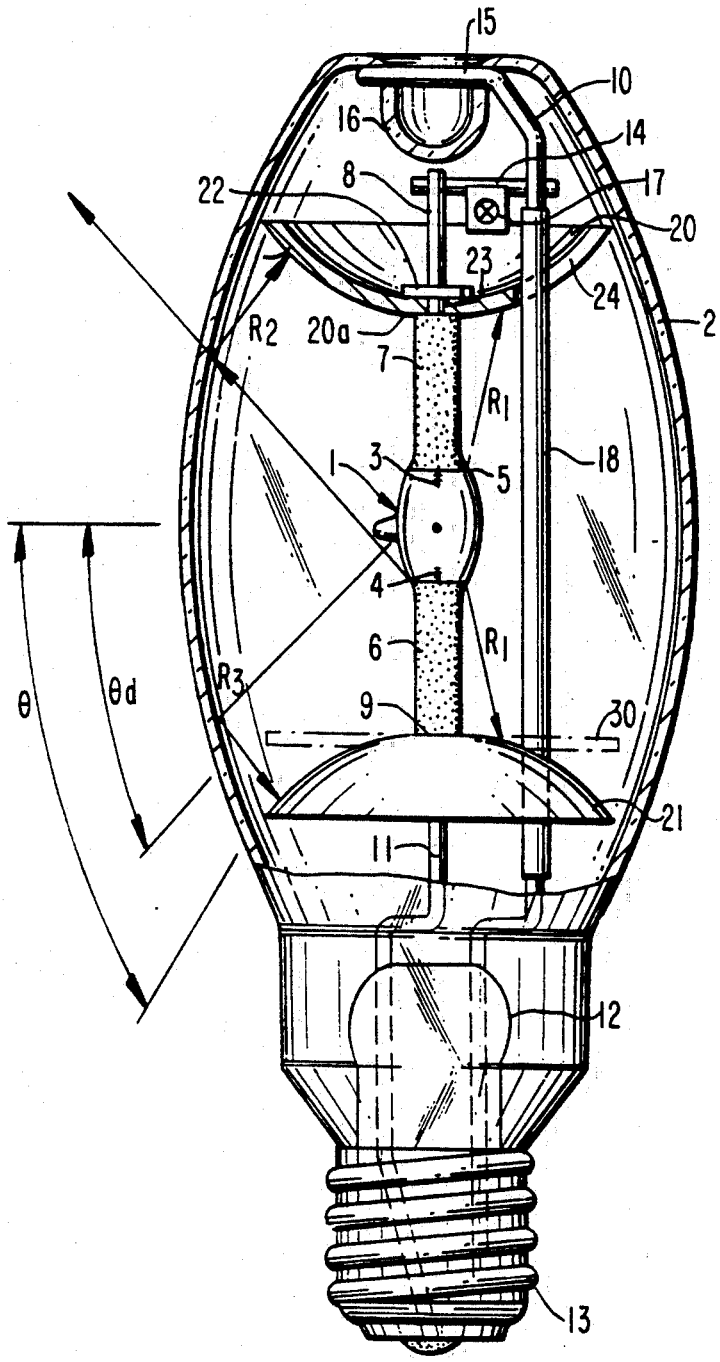
FIG. 1 is an elevation of a low-wattage metal halide discharge lamp according to an embodiment of the invention having a tubular sleeve covering the elongate support rod and a pair of convex dome-shaped screens positioned at opposite ends of the arc tube for further reducing photoelectron production.

The lamp according to the invention is a compact low-wattage metal halide lamp comprised of a light source 1 housed within a bulged tube (BT) outer envelope 2. As used herein, "low wattage" refers to metal halide lamps having a rated wattage of 1OOW or less. The light source 1 is a discharge device having discharge electrodes 3, 4 sealed within a quartz glass discharge vessel, or arc tube, 5 which contains a discharge sustaining filling of alkali-halides. The filling comprises sodium halide, mercury and other metal halides such as thallium iodide. In the usual case the discharge device 1 will also contain a rare gas to facilitate starting. Portions of the discharge vessel 5 adjacent the respective electrodes 3, 4 are coated with a metal oxide layer 6, 7 which suppresses thermal radiation from the coated portions to reduce cooling of the discharge vessel ends.

Conductive lead-throughs 8 and 9 are connected to respective discharge electrodes 3, 4 and extend through the arc tube 5 for external connection.

The metal support structure includes conductive support rods 10, 11 which define a conductive path for applying a voltage to the discharge electrodes, and also provide mechanical support for suspending the discharge device 1 within the otter envelope 2. The conductive support rods 10, 11 extend from the stem press 12 into the interior of the lamp. Opposite ends of the conductive support rods are connected to the lamp base 13 in a manner so that a voltage applied to the lamp base appears across the conductive support rods.

The lead through 8 is electrically connected to the elongate support rod 10 by a conductive transverse support 14. The cross support 14 is welded to the lead-through 8 and to the elongate support rod 10 so as to mechanically support the discharge device 1 and provide a conductive path between the support rod 10 and the lead-through 8. The other lead-through 9 is welded to the shorter conductive support rod 11 to electrically and mechanically connect them. Thus, when a voltage is applied to the lamp base 13 the voltage will be applied to the lead through conductors 8, 9 for establishing a potential difference across the discharge electrodes 3, 4.

The support rod 10 has a loop 15 formed at its end adjacent the lamp envelope end. The loop 15 engages an inward protrusion 16 in the dome end of the lamp envelope to anchor the end of the support rod 10 remote from the stem press 12. A getter support 17 is carried by the cross support 14.

During lamp operation an electrical discharge is developed between the pair of discharge electrodes 3, 4. The discharge develops highly intense visible light which is transmitted from the discharge device 1 and through the lamp outer envelope 2 for the purpose of illumination. Additionally, a strong flux in the ultraviolet region is emitted from the mercury vapor excitation within the discharge device 1.

In prior art discharge lamps without ultraviolet shielding means, ultraviolet photons strike the metal support structure causing the emission of photoelectrons from the metal. The free photoelectrons accumulate on the outer surface of the fused quartz discharge tube 5 and impart a negative charge to it. The negative charge will accelerate the diffusion of sodium ions through the wall of the arc tube 5 resulting in the progressive depletion of the sodium ion concentration within it. This phenomena is referred to as sodium clean-up and is deleterious to lamp quality. As the sodium concentration within the discharge envelope decreases the lamp voltage increases.

To reduce photoelectron emission, a refractory dielectric sleeve 18, such as alumina, covers a major portion of the elongate support rod 10 which is straight. The sleeve 18 is opaque to ultraviolet radiation and has a high photoelectric work function. Consequently, it shields a substantial portion of the metal rod 10 and does not itself contribute to the production of photoelectrons. Thus, there will be fewer photoelectrons available to contribute to sodium cleanup than if the sleeve 18 were not present. The use of sleeve 18 is known from U.S. Pat. No. 3,484,367, as previously discussed.

However, the use of only a sleeve 18 leaves a considerable amount of metal exposed to ultraviolet radiation which generate photoelectrons. For example, the getter support 17, the transverse support 14, the uncovered portions of rod 10 including loop 15, support rod 11 and lead-throughs 8 and 9 are all exposed to ultraviolet radiation from arc tube 5. Photoelectron production from these exposed surfaces is known to contribute to sodium clean-up, causing shortened lamp-life and unacceptably high increases in correlated color temperature (CCT).

To substantially screen all the additional metal parts from ultraviolet photons, screens 20, 21, which are substantially opaque to ultraviolet radiation and have a high photoelectric work function are secured at respective ends of arc tube 5. The screens are circular domes and are convex with respect to the arc tube 5. The screens extend transversely past the support rod 10 and terminate proximate the inner surface 2*a* of the outer envelope. As shown in FIG. 1*a*, the screens have an aperture 23 and an opening in the form of a slot 24 through which the respective lead-throughs and tubular sleeve 18 extend. The screens 20, 21 are in the line of sight between the discharge device 1 and all the uncovered metal parts (10, 11, 14) as shown by rays $R_1$ and thus prevent ultraviolet radiation emitted directly from the discharge device from impinging on such metal parts and emitting photoelectrons. Because of their high photoelectric work function, the screens themselves substantially do not emit any photoelectrons.

Besides the photoelectron production caused by ultraviolet radiation emitted directly from the discharge device, it believed that considerable amounts of photoelectrons are produced by ultraviolet radiation which is reflected off the inside surface of the outer envelope (as shown by rays $R_2$,$R_3$) before impinging on exposed metal parts. The internally reflected ultraviolet radiation is estimated to be in the order of 3–4% of the total ultraviolet radiation emitted by the arc tube.

Because the screens of FIG. 1 substantially extend to the inner surface of the outer envelope, they block a substantial portion of such reflected ultraviolet photons. The convex screens are advantageous, because they allow a larger angle $\Theta$ of visible light to be transmitted through the outer envelope than planar screens of similar diameter, while providing effective screening of the exposed metal parts. A flat screen 30 shown in phantom in FIG. 1, of the same diameter as the convex screens 20, 21, allows a smaller angle $O_d$ of visible light to be transmitted while permitting more reflected photons $R_3$ to pass between the flat screen and the inner surface of the outer envelope because its outer periphery is spaced further from the curved surface of the BT envelope than the convex screen.

The screens 20, 21 consist of VYCOR 7917 or VYCOR 7923 glasses which are extremely attractive for their workability and 0% transmittance of U.V. radiation at wavelengths of 250 nm and below. U.V. radiation at wavelengths of 250 nm and below have been found to be the most critical in causing photoelectron emission. Accordingly, blockage of these wavelengths by the screens 20, 21 is particularly efficacious in screening the uncovered portions of the support structure. The convex screens shown in FIG. 1 have a wall thickness of 1 mm and can be made by pressing and/or machining on a glass lathe.

The convex screens may also be fabricated from machineable ceramics, such as Kersima, a magnesium silicon oxide, which is a ceramic oxide impervious to U.V. radiation and well known to those of ordinary skill in the art. Screens of this material may be formed by pressing the Kersima in a suitable mold to obtain the "green" ceramic part, and then by sintering according to well known processes to obtain the finished ceramic part. The screens may alternatively consist of a machineable glass which is not itself impervious to U.V. radiation but which is provided with a coating opaque to U.V. radiation. Suitable coatings include zirconium oxide or an optical interference coating selected to block ultraviolet radiation from passing through the screens. Optical interference coatings are well known to those of ordinary skill in the art, for example, from U.S. Pat. No. 4,949,005 (Parham et al).

The screens are secured by metal tabs 22 which are welded to the lead-throughs and butt against the screen, securing the screen against the respective end of the arc tube. The screens have a flat portion 20*a* surrounding the aperture 23 which is engaged by tabs 22. The aperture openings preferably have a clearance fit with their respective lead-throughs/sleeve to minimize the amount of ultraviolet radiation which can pass therethrough. The clearance fit also provides transverse support for the screens. The clearance between the outer edge of the screen and the inner surface of the outer envelope is selected to prevent impact of the screens against the outer envelope, and thus breakage, when the lamp is subjected to shocks.

Figure 2:
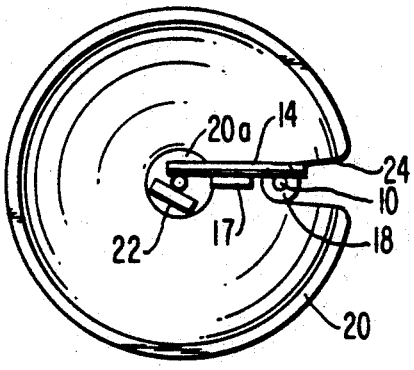
FIG. 2 is an elevation of a low-wattage metal halide lamp in which the screens are disk-shaped.
Figure 3:
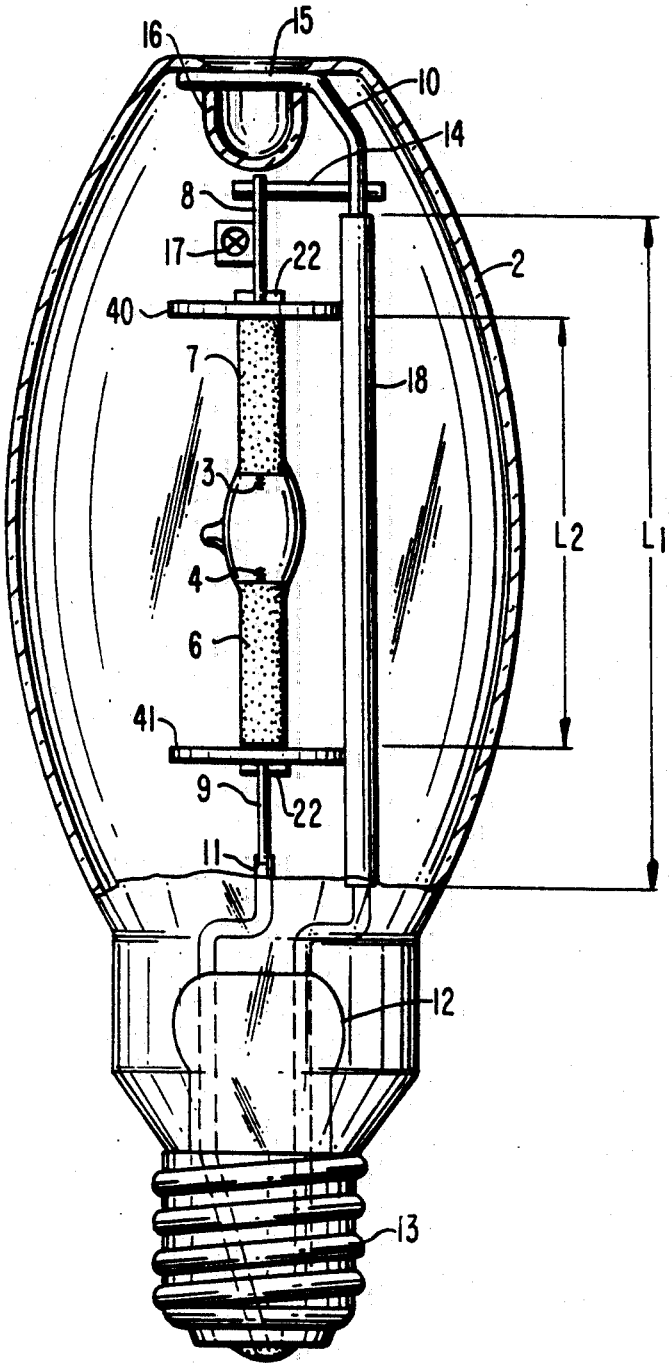

FIG. 2 shows another embodiment of the invention, in which the screens 40, 41 are disk-shaped and also consist of VYCOR 7917 or VYCOR 7923. Similar lamp components have the same reference numerals as in FIG. 1. The tubular sleeve 18 is Kersima and extends a distance L1 on the major portion of the metal support rod 10. The disk-shaped screens are separated a distance L2, where L2<L1, and have a diameter D extending to sleeve 18, blocking the line of sight from the arc tube to any portion of the metal support structure not covered by sleeve 18. The disks are similarly provided with central apertures 42, so they can be slipped over the ends of the lead-throughs and butt against the ends of the arc tube, and are secured by respective tabs welded on the lead-throughs. In the lamp of FIG. 2, the disks have a diameter of 24 mm and a thickness of 2 mm. The VYCOR glass disks of FIG. 2 are less costly to fabricate than the convex screens of FIG. 1.

To determine the effectiveness of the invention, six 70 watt metal halide lamps according to the lamp of FIG. 2 were life tested for five thousand (5000) hours in closed fixtures. The disk-shaped VYCOR screens according to the embodiment of FIG. 2 were used for the test because of their ease of fabrication. Six control lamps, identical but for the absence of the disks 40, 41, were burned in open air. The data for the measured voltage rise for the six lamps according to the invention and the six control lamps are shown below out to 5,000 hours.

| | INVENTION (Side Rod + Disks) | | CONTROL (Side Rod, No Disks) | |
|---|---|---|---|---|
| Burning Hours | Voltage Rise | (STD) | Voltage Rise | (STD) |
| 500 | −0.02 | (1.1) | | |
| 1000 | −1.0 | (1.0) | +1.1 | (0.9) |
| 1500 | +0.4 | (1.0) | +2.0 | (2.9) |
| 2000 | +1.0 | (1.2) | +4.1 | (4.0) |
| 2500 | +1.5 | (0.7) | +4.2 | (2.3) |
| 3000 | +2.4 | (1.5) | +6.8 | (4.5) |
| 4000 | +3.5 | (1.6) | +9.6 | (2.7) |
| 5000 | +4.6 | (2.2) | +13.3 | (2.9) |

At the end of rated life, the voltage rise in the lamp according to the invention was 65 percent lower than in the control lamps without the disks. However, since the control lamps were operated in open air, which is a much less harsh condition than the operation in enclosed fixtures as were the lamps according to the invention, the difference between the control lamps and the lamps according to the invention can be expected to be greater if the lamps were operated under similar conditions. Additionally, the lamps of FIG. 1 can be expected to have an even lower voltage rise because of the greater amount of reflected ultraviolet radiation blocked by the convex screens of 20, 21 of FIG. 1 as compared to disks 40, 41.

Those of ordinary skill in the art will appreciate that other variations are permissible within the scope of the invention as defined by the appended claims. For example, any material which blocks UV radiation and has a sufficiently high photoelectric work function may be used to construct or coat the screens. The screens may also be used for higher wattage metal halide lamps having press seals and a starter electrode. However, at least one of the shields would have an additional aperture through which the additional lead-through for the starter electrode would extend. The benefits of the interposed screens are also achieved in outer-envelopes other than "BT's," for example, straight tubular "T" bulbs. Furthermore, a sleeve 18 of fused quartz may be used which, although not opaque to ultraviolet radiation, substantially prevents photoelectrons from the elongate support rod from collecting on the arc tube. However, this would be expected to yield reduced results as compared to a cover which is opaque to ultraviolet radiation, such as Kersima.

We claim:

1. In a single-ended electric lamp having an outer envelope defining a lamp axis, an alkali-halide containing light source that emits ultraviolet radiation, and metal support structure for supporting said light source within said outer envelope, said support structure comprising an elongate support rod extending adjacent said light source, the improvement comprising:

a cover extending over a length of said elongate support rod and a screen arranged within said outer envelope and spaced from an uncovered portion of said support structure which is positioned off of the lamp axis and not covered by said cover on said support rod, said screen comprising a material substantially opaque to ultraviolet radiation and having a high photoelectric work function, said screen being shaped and positioned to block the line of sight from said light source to aid uncovered portion of said metal support structure positioned off the lamp axis to prevent ultraviolet radiation emitted from said light source from impinging directly on said uncovered portion, thereby reducing photoelectron emission from the uncovered portions of said metal support structure.

2. In a single-ended lamp having an outer envelope defining a lamp axis and having a base end and a dome end opposite said base end, an alkali-halide containing light source that emits ultraviolet radiation, and metal support structure for supporting said light source within said outer envelope coaxial with said lamp axis, said support structure comprising an elongate support rod extending adjacent said light source from said base end to said dome end of said envelope and including metallic portions adjacent each end of said envelope which are positioned off of the lamp axis, the improvement comprising:

a cover extending over a length of said elongate support rod, and a plurality of screens arranged within said outer envelope, said screens each comprising a material substantially opaque to ultraviolet radiation and having a high photoelectric work function, said screens being shaped and positioned to block the line of sight from said light source to any portion of said metal support structure that is not covered by said cover on said elongate support rod and to reduce the quantity of ultraviolet radiation reflected off the inner surface of said outer envelope which impinges on any uncovered portion of said metal support structure.

3. In a single-ended electric lamp according to claim 2, wherein said lamp includes a pair of said screens, each positioned adjacent a respective end of said light source and transverse to said light source.

4. In a single-ended electric lamp according to claim 3, wherein said screens extend to said cover on said elongate support rod.

5. In a single-ended electric lamp according to claim 4, wherein said screens are dome-shaped and convex with respect to said light source.

6. In a single-ended electric lamp according to claim 4, wherein said screens are disk-shaped.

7. In a single-ended electric lamp according to claim 4, wherein said screen extend transversely past said cover on said elongate support rod.

8. In a single-ended electric lamp according to claim 7, wherein said screens are dome-shaped and convex with respect to said light source.

9. In a single-ended electric lamp according to claim 7, wherein said screens are disk-shaped.

10. A single-ended metal halide discharge lamp, comprising:

a bulged-tube outer envelope having a neck portion, a bulbous portion adjacent said neck portion having a diameter larger than said neck position and an inner convex surface, and a lamp cap at a sealed end thereof, said lamp envelope defining a lamp axis;

a double-ended discharge device within said envelope comprised of an arc tube having an ionizable filling comprising mercury, sodium halide, and another metal halide, a pair of spaced discharge electrodes, and conductive lead-throughs extending from said electrodes each through a respective sealed end of said arc tube, said discharge device emitting visible and ultraviolet radiation during lamp operation;

metal support structure for supporting said arc tube substantially axially within said bulbous portion of said envelope with said lead-throughs directed towards and away from said lamp cap, respectively, said support structure comprising an elongate metal support rod extending lengthwise within said outer envelope, a shorter metal support rod extending adjacent said elongate support rod and connected to said lead-through which extends towards said lamp cap, and a transverse metal support extending transversely from said elongate support rod a distance form said shorter support rod and connected to said other lead-through;

a tubular cover extending over a length L1 of said elongate support rod; and a pair of screens each positioned at an opposite end of said discharge device and spaced apart a distance L2, wherein $L2<L1$, said tubular cover and said screens each comprising a material substantially opaque to ultraviolet radiation and having a high photoelectric work function, and said screens having diameters and positions selected to block the line of sight from said discharge device to any portion of said metal support structure that is not covered by said tubular cover and to reduce the quantity of ultraviolet radiation reflected off the inner surface of said outer envelope which impinges on any uncovered portion of said metal support structure.

11. A single-ended metal halide discharge lamp according to claim 10, wherein a major portion of said elongate support rod is straight and said cover on said elongate support rod is a straight tube with said elongate support rod extending therethrough; and said screen have a diameter extending to said straight tube of said material.

12. A single-ended electric lamp according to claim 11, wherein said screens are dome-shaped and convex with respect to said light source.

13. A single-ended electric lamp according to claim 11, wherein said screens are disc-shaped.

14. A single-ended metal halide discharge lamp according to claim 11, wherein said tubular cover and said screens each comprise a material having 0% transmittance at wavelengths of 250 nm and below.

15. A single-ended metal halide discharge lamp according to claim 10, wherein a major portion of said elongate support rod is straight and said cover on said elongate support rod is a straight tube with said elongate support rod extending therethrough; and said screens extend transversely past said tubular cover on said elongate support rod and include an opening through which said tubular cover and said support rod extend.

16. A single-ended electric lamp according to claim 15, wherein said screens are dome-shaped and convex with respect to said light source.

17. A single-ended electric lamp according to claim 15, wherein said screens are disk-shaped.

18. A single-ended metal halide discharge lamp according to claim 15, wherein said tubular cover and said screens each comprise a material having 0% transmittance at wavelengths 250 nm and below.

19. A single-ended metal halide discharge lamp according to claim 10, wherein said screens have an aperture through which said lead-throughs extend and are secured against respective ends of said arc tube by welded tabs.

20. A single-ended metal halide discharge lamp according to claim 10, wherein said tubular cover and said screens each comprise a material having 0% transmittance at wavelengths of 250 nm and below.

* * * * *